US010814362B2

(12) United States Patent
Pierz

(10) Patent No.: US 10,814,362 B2
(45) Date of Patent: Oct. 27, 2020

(54) EXHAUST PASSAGE DEPOSIT MITIGATION

(71) Applicant: Insitu, Inc., Bingen, WA (US)

(72) Inventor: Patrick Malachy Pierz, Hood River, OR (US)

(73) Assignee: The Boeing Company, Chicago, IL (US)

( * ) Notice: Subject to any disclaimer, the term of this patent is extended or adjusted under 35 U.S.C. 154(b) by 155 days.

(21) Appl. No.: 15/974,618

(22) Filed: May 8, 2018

(65) Prior Publication Data

US 2019/0344313 A1 Nov. 14, 2019

(51) Int. Cl.

| | |
|---|---|
| ***B08B 9/027*** | (2006.01) |
| ***F01N 13/08*** | (2010.01) |
| ***F01N 1/00*** | (2006.01) |

(52) U.S. Cl.

CPC ..... *B08B 9/027* (2013.01); *F01N 1/00* (2013.01); *F01N 13/08* (2013.01); *F01N 2290/10* (2013.01)

(58) Field of Classification Search

CPC ... B08B 9/027; B08B 1/005; B08B 2209/027; F01N 13/08; F01N 1/00; F01N 2290/10; F01N 2260/04; F01N 2470/20; F01N 2470/24; F01N 2530/00; F01N 2290/08

See application file for complete search history.

(56) References Cited

U.S. PATENT DOCUMENTS

| | | | | |
|---|---|---|---|---|
| 3,268,007 A | | 8/1966 | Bodie | |
| 4,583,585 A | * | 4/1986 | Estienne | F28G 1/12 122/379 |
| 5,457,749 A | * | 10/1995 | Cain | F01N 1/065 381/71.5 |
| 8,176,885 B2 | * | 5/2012 | Pierz | F01P 11/06 123/41.01 |
| 2015/0017073 A1 | * | 1/2015 | Tolle | B01D 53/0407 422/169 |

FOREIGN PATENT DOCUMENTS

| | | | |
|---|---|---|---|
| CN | 206801671 U | * | 12/2017 |
| CN | 206801671 U | | 12/2017 |
| FR | 2568493 A1 | | 2/1986 |
| JP | H06134424 A | | 5/1994 |
| WO | WO9812422 A1 | | 3/1998 |

OTHER PUBLICATIONS

Machine translation of CN206801671U (Year: 2017).*

Extended European Patent Search Report dated Jul. 24, 2019, regarding Application No. 19172243.8, 8 pgs.

European Patent Office Communication, dated Jun. 22, 2020, regarding Application No. 19172243.8, 5 pages.

* cited by examiner

*Primary Examiner* — Douglas Lee

(74) *Attorney, Agent, or Firm* — Yee & Associates, P.C.

(57) ABSTRACT

A self-cleaning duct assembly. The self-cleaning duct assembly includes a hollow member having an inner surface, the inner surface defining a central axis and a flow passage for directing a fluid flow along the central axis. The self-cleaning duct assembly also includes a resilient member including a plurality of arcuate segments disposed along the central axis, each of the arcuate segments spaced from the inner surface. The arcuate segments intermittently contact the inner surface as the resilient member is induced to move within the hollow member.

20 Claims, 6 Drawing Sheets

EXHAUST PASSAGE DEPOSIT MITIGATION

BACKGROUND INFORMATION

1. Field

The present disclosure relates to techniques for removing, mitigating, and preventing deposit buildup inside an exhaust pipe.

2. Background

Internal combustion engines, such as but not limited to gasoline and diesel engines, create by-products of combustion that are emitted ultimately through an exhaust pipe. Other types of machines and engines also produce by-products emitted through an exhaust pipe. It is well known that undesirable deposits from the exhaust can build up on the inner wall of the exhaust pipe. For example, these deposits can impede flow of exhaust gasses.

SUMMARY

The illustrative embodiments provide for a self-cleaning duct assembly. The self-cleaning duct assembly includes a hollow member having an inner surface, the inner surface defining a central axis and a flow passage for directing a fluid flow along the central axis. The self-cleaning duct assembly also includes a resilient member including a plurality of arcuate segments disposed along the central axis, each of the arcuate segments spaced from the inner surface. The arcuate segments intermittently contact the inner surface as the resilient member is induced to move within the hollow member.

The illustrative embodiments also provide for a self-cleaning exhaust system. The self-cleaning exhaust system includes an exhaust duct connectable to a machine that produces exhaust, the exhaust duct having a longitudinal axis, a first diameter, and an inner wall. Self-cleaning exhaust system is a coil connected to the exhaust duct and disposed inside the exhaust duct along the longitudinal axis. The coil has a pitch and a second diameter. The second diameter is less than first diameter. The coil is configured to vibrate with an amplitude sufficiently large such that at least part of the coil will repeatedly impact the inner wall when exhaust flows through the exhaust duct.

The illustrative embodiments also provide for a self-cleaning method for an exhaust system. The method includes: receiving in an exhaust duct, and a flow of exhaust gas. The method also includes inducing vibrations, using the flow of exhaust gas, in a coil disposed inside the exhaust duct. The method also includes impacting, via the vibrations, the inner walls of the exhaust duct by the coil with sufficient force such that exhaust residue from the exhaust gas either is removed from the inner walls or prevented from being deposited on the inner walls.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
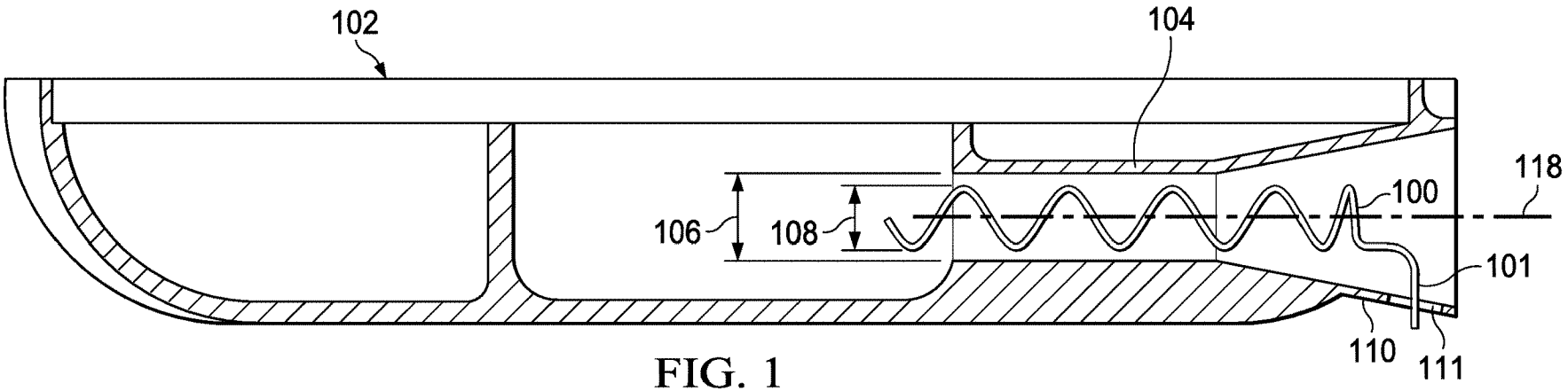
FIG. 1 is an illustration of a cross section of a machine having an exhaust pipe with a vibrating element disposed therein, in accordance with an illustrative embodiment.

The illustrative embodiments recognize and take into account that, during operation, engines can accumulate deposits in the exhaust system to such an extent that the deposits negatively impact performance. The most sensitive location to deposits in some machines or engines is in the stinger passage found in the muffler, which may be any narrower passage relative to other passages in the exhaust system.

Thus, the illustrative embodiments provide for devices and methods to insert a vibrating element, preferably in the form of a metal coil, in the narrower passage that moves in response to engine vibration and the pulsing of the exhaust. This relative motion will produce an intermittent contact between the metal coil and the internal surface of the passage. This intermittent contact will remove any deposits that begin to form on the surface, keeping it clean for the entire life of the engine. As defined herein, the term "clean" refers to deposit buildups that are less than a threshold buildup at which engine or machine performance is undesirably impacted.

The illustrative embodiments also recognize and take into account that the metal coil should have design parameters selected correctly to ensure successful operation. Parameters include the mass of the spring, which is influenced by the gauge of the wire or coil. Another parameter includes the clearance between the coil and the passage. Another parameter includes the pitch of the coil or wire. Another parameter includes the material of the coil or wire. The mass of the spring and clearance will determine the impact energy against the exhaust duct. Too little energy will reduce the effectiveness of self-cleaning, but too much energy has the potential to cause undesirable wear on the exhaust duct. The pitch of the coils together with the attachment motion range will ensure the coil will contact the entire duct passage. Finally, the coil material selection should ensure that no corrosion occurs in the wire or coil, and that there are no compatibility issues that could impact the expected life of the exhaust assembly.

Thus, in an example, the illustrative embodiments provide for a coiled body disposed within a passage of a muffler. The coiled body is positioned along a central axis of the passage and spaced from the walls defining the passage. As the vehicle operates, vibrations from the engine and pulses from the exhaust flow cause the coiled body to flex and/or vibrate and repeatedly come into contact with the walls. This repeated striking cleans accumulated sediment from the walls.

FIG. 1 through FIG. 4 should be considered together. Reference numerals in FIG. 1 through FIG. 4 refer to similar objects and share similar descriptions.

Figure 2:
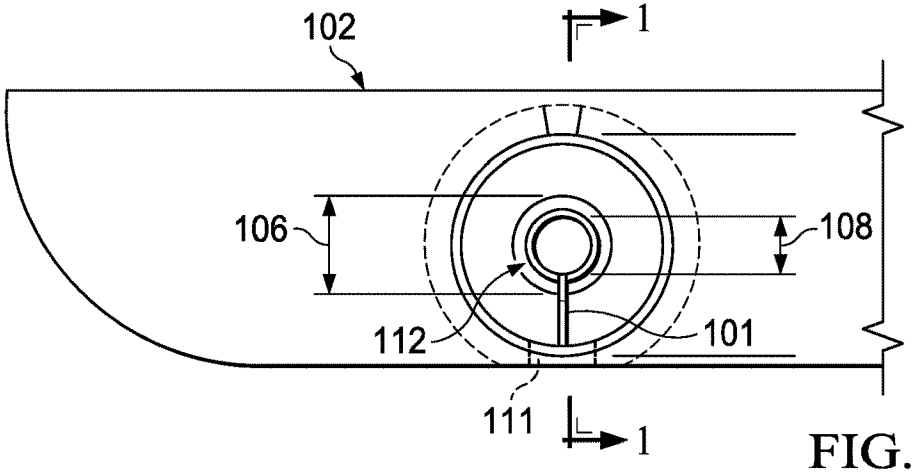
FIG. 2 is an illustration of another cross section of the machine shown in FIG. 1, in accordance with an illustrative embodiment.

Attention is first turned to FIG. 1 and to FIG. 2. FIG. 1 illustrates a cross section of a machine having an exhaust pipe with a coil disposed therein, in accordance with an illustrative embodiment. FIG. 2 illustrates another cross section of the machine shown in FIG. 1, in accordance with an illustrative embodiment.

Vibrating element 100 is a coil in this illustrative embodiment, but in other illustrative embodiments vibrating element 100 need not be a coil, but could be some other wire or shaped object, including possibly an elongate brush, a helix, a cylinder, a shape matching a shape of duct 104, or some other shape.

Vibrating element 100 is disposed in exhaust system 102. Exhaust system 102 is part of a larger engine or machine which produces exhaust, with the exhaust exiting the engine or machine via exhaust system 102. The exit portion of exhaust system 102 may be referred to as duct 104.

Duct 104 may be of a variety of shapes, and need not be a circular or oval pipe. Generally, duct 104 has a bore diameter, 106, that is smaller than other parts of exhaust system 102. While in this illustrative embodiment duct 104 is near the terminus of exhaust system 102, duct 104 could be deeper within exhaust system 102. Additionally, while duct 104 is shown with a terminus that flares outwardly, the precise shape of the terminus of duct 104 may vary.

In the illustrative embodiment of FIG. 1, vibrating element 100 is disposed longitudinally within duct 104. Vibrating element 100 may extend further into exhaust past duct 104, as shown, but need not necessarily do so.

Vibrating element is preferably anchored at anchor point 110 via prong 101 to duct 104 on one side of duct 104. As shown, vibrating element 100 is anchored to only one wall of duct 104 at only one end of vibrating element 100. In an illustrative embodiment, prong 101 is disposed in slot 111. In an illustrative embodiment, slot 111 extends in an axial direction relative to axis 118 inside the surface of duct 104. Prong 101 and slot 111 are sized and dimensioned so as to allow prong 101 to slide back and forth within slot 111 In this manner, vibrating element 100 is allowed to vibrate relatively freely in an axial direction within duct 104, while vibrating element 100 repeatedly strikes the walls of duct 104. Prong 101 may be anchored in slot 111 by a number of means. In one illustrative embodiment, the overall size of vibrating element 100 prevents prong 101 from exiting slot 111 in a radial direction relative to axis 118 because the inner walls of duct 104 constrain vibrating element 104 from exiting slot 111. In another illustrative embodiment, one or more flanges protruding out of or into the page of FIG. 1 and into transverse slots (not shown) could constrain the movement of prong 101 from leaving slot 111.

In other illustrative embodiments, however, vibrating element 100 may be anchored to more than wall, including for example being a continuous loop anchored continuously within the inner diameter of duct 104. In other illustrative embodiments, vibrating element 100 may be anchored at both ends, and possibly at one or more points along the longitudinal length of vibrating element 100. Nevertheless, one preferred illustrative embodiment is to anchor vibrating element 100 at only one end of duct 104.

Vibrating element 100 has outer diameter, 108, which in the illustrative embodiment shown is the outer diameter of the coil illustrated. Outer diameter 108 is smaller than bore diameter 106, which defines the inner walls of duct 104. However, outer diameter 108 of vibrating element 100 is preferably close to bore diameter 106 such that vibrating element 100 will continuously strike along the entire length of the inner walls of duct 104 as vibrating element 100 vibrates.

The vibration of vibrating element 100 typically occurs as a result of engine vibration and/or exhaust flow through duct 104. Thus, vibrating element 100 is a passive device in exhaust system 102. However, in other illustrative embodiments, it is possible to attach an actuator to one or more parts of vibrating element 100, such as at anchor point 110, in order to force vibrating element 100 to vibrate or to force vibrating element 100 to vibrate more vigorously.

FIG. 2 shows a view of exhaust system 102 in which the reader is looking into the terminus of duct 104. As can be seen, bore diameter 106 of duct 104 is close to outer diameter 108 of vibrating element 100. Note that inner circle 112 is not vibrating element 100, but rather is the point where the flare at the terminus of duct 104 reaches a minimum radius.

FIG. 2 also shows that slot 111 may have different shapes from that described with respect to FIG. 1. For example, slot 111 could extend in a radial direction relative to axis 118, as shown in FIG. 2. In this manner, prong 101 could move radially as well as axially, relative to axis 118, during operation of exhaust system 102. Slot 111 could also have a number of different shapes. For example, slot 111 could be helically shaped in order to allow vibrating member 111 to move in a curved manner with respect to the inner walls of duct 104.

Figure 3:
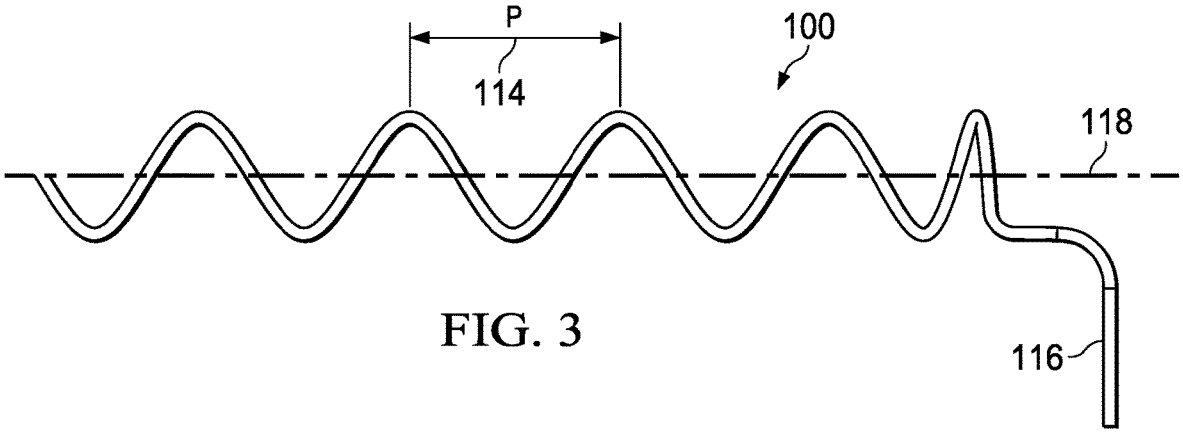
FIG. 3 is an illustration of a vibrating element shown in FIG. 1, in accordance with an illustrative embodiment.
Figure 4:
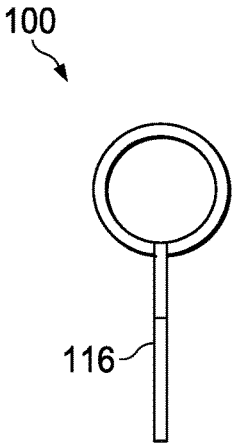
FIG. 4 is an illustration of a cross section of the vibrating element shown in FIG. 3, in accordance with an illustrative embodiment.

FIG. 3 illustrates the vibrating element shown in FIG. 1, in accordance with an illustrative embodiment. FIG. 4 illustrates a cross section of the vibrating element shown in FIG. 3, in accordance with an illustrative embodiment. Together, FIG. 3 and FIG. 4 illustrate different views of vibrating element 100.

Vibrating element 100 is shown as a coil having pitch 114, indicated by "P". Pitch 114 may be uniform, or it may vary over the length of vibrating element 100. In the illustrative embodiment shown, pitch 114 is uniform along most of its length, but shortens near prong 116. Prong 116 serves as an anchor when embedded inside the inner wall of duct 104, typically near the terminus of duct 104. The exact placing of anchor point 110 may vary, but should be selected in a manner that vibrating element 100 is allowed to vibrate freely within duct 104.

Thus, the illustrative embodiments of FIG. 1 through FIG. 4 provide for a vibrating element 100 in a passage duct 104. This arrangement has been shown in some applications to clean (or keep clean) the passage in the presence of adhering deposits. Thus, the illustrative embodiments also provide for a method to insert vibrating element 100 in the exhaust muffler passage that moves in response to engine vibration and the pulsing of the exhaust. This relative motion will produce an intermittent contact between the vibrating element 100 and the internal surface of the passage. This intermittent contact will remove any deposits that begin to form on the surface keeping it clean, possibly for the entire life of the engine.

Design of vibrating element 100 may vary based on the particular device in question, operating parameter and size of the machine, engine, or exhaust system, and other parameters. Such parameters include, but are not limited to, the mass of vibrating element 100, which is influenced by the gauge of the wire and, if a coil, the spring constant of the coil. Another parameter is the clearance between the coil and the passage. Another parameter is pitch 114 of vibrating element 100. Another parameter is the material of vibrating element 100, which should be able to resist, long term, the temperatures and chemicals to which vibrating element 100 will be exposed during the expected life of exhaust system 102.

The mass of vibrating element 100 and the clearance will determine the impact energy. Too little energy will reduce effectiveness and too much energy has the potential to cause wear in duct 104 that would be detrimental. The pitch of the coils together with the motion range of vibrating element 100 will ensure the coil will contact the entire passage of duct 104. Finally, the material should be selected to ensure no corrosion or compatibility issues that could impact the component life. In an illustrative embodiment, stainless steel would be an appropriate material, though many other metals with similar qualities could be used.

Attention is now turned to the design considerations of manufacturing vibrating element 100 for a particular application. Outer diameter 108 should be between about 60% and 98% of bore diameter 106. This size range helps ensure that vibrating element 100 will contact all the surfaces of the inner walls of duct 104 during normal operation of exhaust system 102.

Pitch 114 is set to a value to help ensure all surfaces of the inner walls of duct 104 will be contacted by vibrating element 100 during normal operation. Pitch 114 need not be constant. Pitch 114 may also be selected based on how far vibrating element 100 extends longitudinally along axis 118 during normal vibration. In other words, vibrating element 100 not only vibrates radially against the inner walls of duct 104, but also along the length of duct 104. In an illustrative embodiment, pitch 114 may be selected to correspond to about a distance moved by vibrating element 100 along axis 118 during normal operation.

Attention is now turned to design considerations regarding the material used to fashion vibrating element 100. The material of vibrating element 100 is selected to vibrating element 100 retains its physical characteristics in the presence of the fluid passing through exhaust system 102. Therefore, vibrating element 100 should resist the temperature and corrosive effects without degradation. The material is also selected for compatibility with the material of which duct 104 is formed in order to help ensure there is no unacceptable wear of either vibrating element 100 or the duct 104. The material should also be compatible with forming vibrating element 100 in the desired shape. A suitable material is stainless steel, however other materials could also be acceptable, including not just metals but also possibly certain composite materials.

In an illustrative embodiment, vibrating element 100 may be a wire. The gauge of the wire may be selected to provide an acceptable pressure drop for the fluid moving through the passage. An acceptable pressure drop is defined to be a pressure drop which does not undesirably impact performance of exhaust system 102, which performance varies with the particular machine or engine in question. As the coil of vibrating element 100 will reduce the cross-section of exhaust flow, the impact of vibrating element 100 on the exhaust flow should be considered. The projected area of vibrating element 100 should be between about 2% and 20% of the projected area of duct 104, or as alternatively termed, the projected area of the bore.

Figure 5:
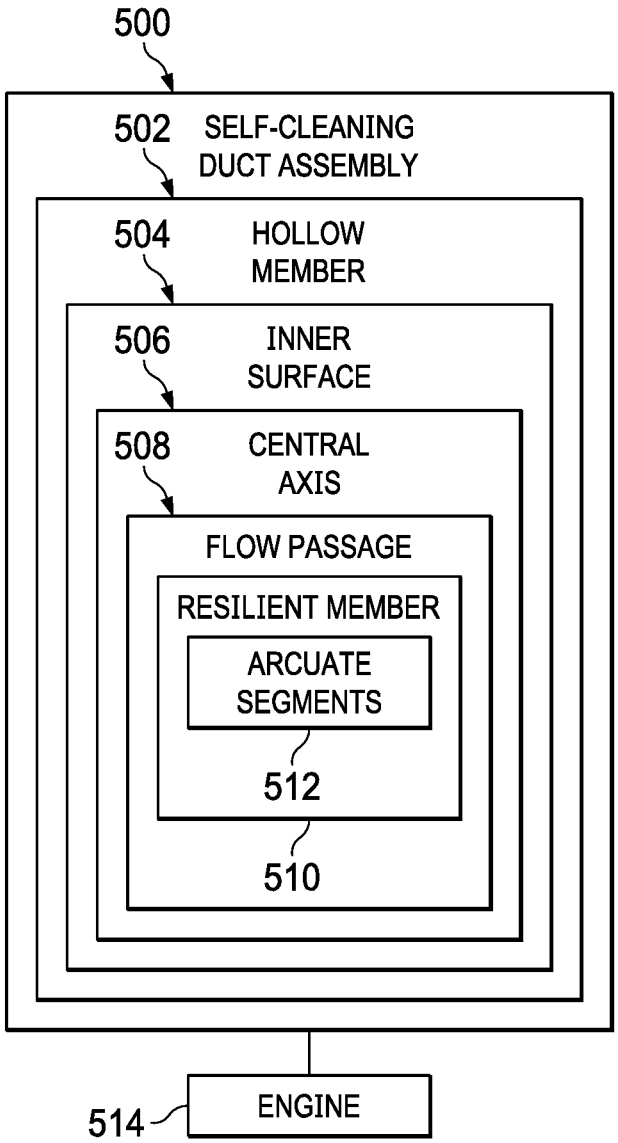
FIG. 5 is an illustration of a block diagram of a self-cleaning duct assembly, in accordance with an illustrative embodiment.

FIG. 5 illustrates a self-cleaning duct assembly, in accordance with an illustrative embodiment. Self-cleaning duct assembly 500 is a variation of vibrating element 100 and exhaust system 102 of FIG. 1.

Self-cleaning duct assembly 500 also includes hollow member 502 having inner surface 504. Inner surface 504 has central axis 506 and flow passage 508 for directing a fluid flow along central axis 506. Self-cleaning duct assembly 500 also includes resilient member 510. Resilient member 510 includes a plurality of arcuate segments 512 disposed along central axis 506. Each of arcuate segments 512 is spaced from inner surface 504. Arcuate segments 512 intermittently contact inner surface 504 as resilient member 510 is induced to move within hollow member 502.

Self-cleaning duct assembly 500 may be varied. For example the fluid flow through hollow member 502 induces resilient member 510 to move. In another illustrative embodiment, hollow member 510 is coupled to engine 514 and operational vibrations from engine 514 induce resilient member 510 to move.

Other variations are also possible. Thus, the illustrative embodiments described with respect to FIG. 5 do not necessarily limit the claimed inventions.

Figure 6:
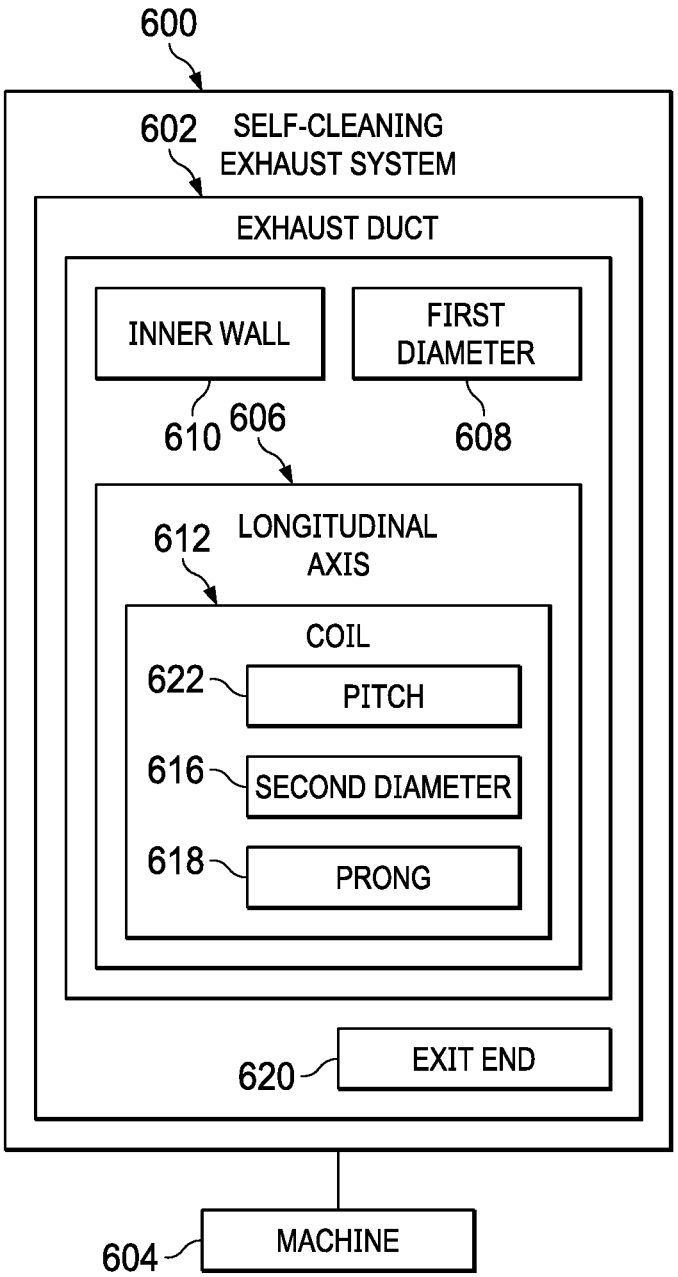
FIG. 6 is an illustration of a block diagram of a self-cleaning exhaust system, in accordance with an illustrative embodiment.

FIG. 6 illustrates a self-cleaning exhaust system, in accordance with an illustrative embodiment. Self-cleaning exhaust system 600 is a variation of the illustrative embodiments described with respect to FIG. 1 through FIG. 5.

Self-cleaning exhaust system 600 may include exhaust duct 602 connectable to machine 604 that produces exhaust. Exhaust duct 602 has longitudinal axis 606, first diameter 608, and inner wall 610. Self-cleaning exhaust system 600 also includes coil 612 connected to exhaust duct 602 and disposed inside exhaust duct 602 along longitudinal axis 606. Coil 612 has pitch 622 and second diameter 616. Second diameter 616 is less than first diameter 608. Coil 612 is configured to vibrate with an amplitude sufficiently large such that at least part of coil 612 will repeatedly impact inner wall 610 when exhaust flows through exhaust duct 602.

The illustrative embodiment described with respect to FIG. 6 may be varied. For example, coil 612 and longitudinal axis 606 may be concentric.

Additionally, coil 612 may be connected to exhaust duct 602 solely at one end of exhaust duct 602. Further, coil 612 may connect to exhaust duct 602 via prong 618 of coil 612 that extends from coil 612 and into inner wall 610. Further yet, prong 618 may be disposed in exit end 620 of exhaust duct 602.

In a different illustrative embodiment, coil 612 may be a helical coil. In yet another illustrative embodiment, coil 612 may have pitch 622. In this case, pitch 622 may be selected such that an entire surface of inner walls 610 is contacted by coil 612 during vibration and extension of coil 612 while exhaust duct 602 is in operational use.

In another illustrative embodiment, coil 612 second diameter 616 may be between about 60% and 98% of first diameter 608 of exhaust duct 602. In still another illustrative embodiment, coil 612 may be made from stainless steel. However, coil 612 may also be made from other metals, alloys, or composite materials depending on a particular engineering application. Additionally, coil 612 may have a gauge selected such that a total area of coil 612 is between about 2% and 20% of an area of exhaust duct 602.

In yet another illustrative embodiment, exhaust duct 602 may be a muffler. In this case, self-cleaning exhaust system 600 is connected to machine 604, which may be selected from the group consisting of an automobile and an aircraft. However, machine 604 may be any machine or engine which produces exhaust or other waste products which might build up within a duct or a pipe over time.

Figure 7:
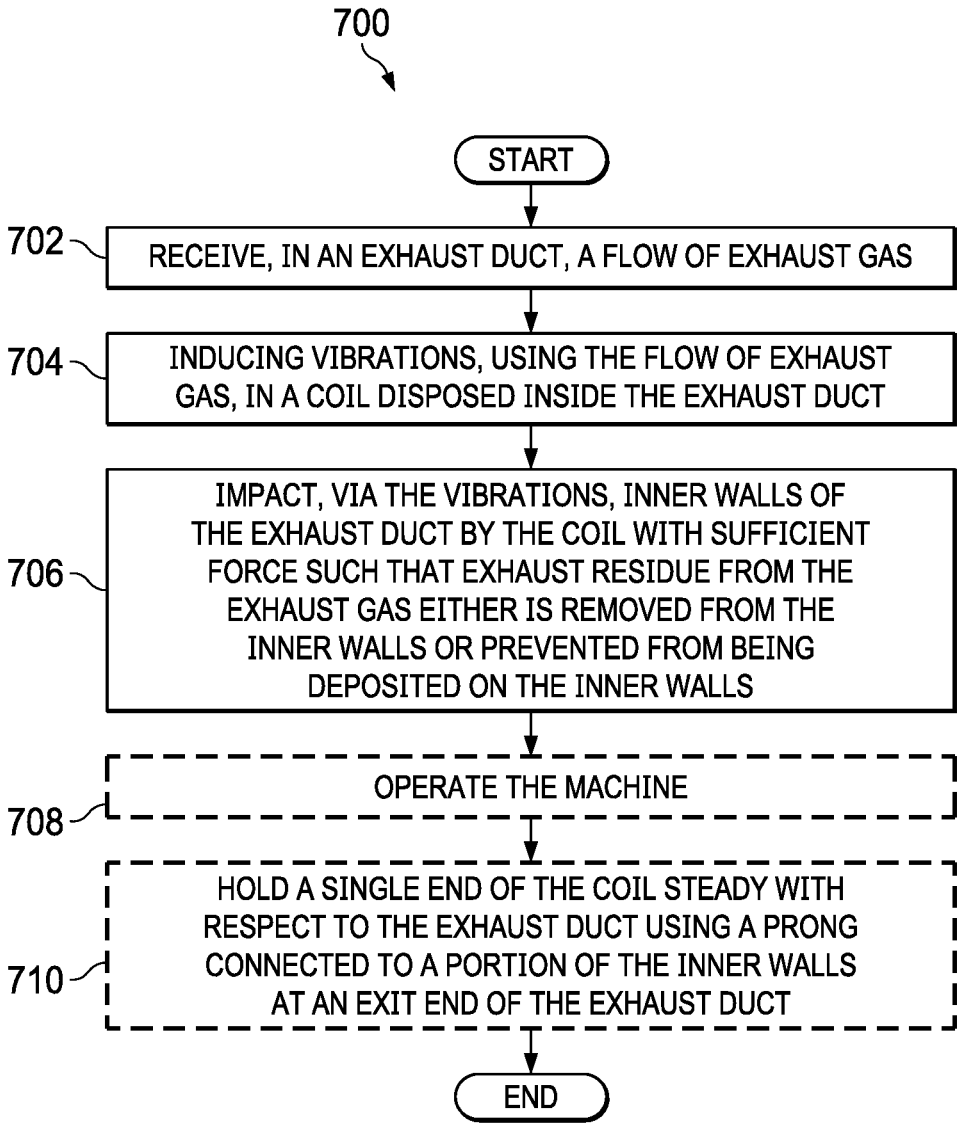
FIG. 7 is an illustration of a block diagram of a method for self-cleaning an exhaust system, in accordance with an illustrative embodiment.

FIG. 7 illustrates a method for self-cleaning an exhaust system, in accordance with an illustrative embodiment. Method 700 may be implemented using any of the devices described with respect to FIG. 1 through FIG. 6.

Method 700 includes receiving, in an exhaust duct, a flow of exhaust gas (operation 702). Method 700 also includes inducing vibrations, using the flow of exhaust gas, in a coil disposed inside the exhaust duct (operation 704). Method 700 also includes impacting, via the vibrations, inner walls of the exhaust duct by the coil with sufficient force such that exhaust residue from the exhaust gas either is removed from the inner walls or prevented from being deposited on the inner walls (operation 706). In one illustrative embodiment, the method 700 may terminate thereafter.

However, method 700 may be varied. Optional operations are shown inside dashed boxes.

For example, in an illustrative embodiment, the exhaust gas is produced by a machine connected to the exhaust duct, and in this case method 700 further includes operating the machine (operation 708). In this case, inducing vibrations at operation 704 may include vibrations in both an axial direction of the coil and a radial direction of the coil. Still further, method 700 also may include holding a single end of the coil steady with respect to the exhaust duct using a prong connected to a portion of the inner walls at an exit end of the exhaust duct (operation 710). In another illustrative embodiment, the method may terminate thereafter.

Still other variations are possible. Therefore, the illustrative embodiments described with respect to FIG. 7 do not necessarily limit the other illustrative embodiments described herein.

Figure 8:
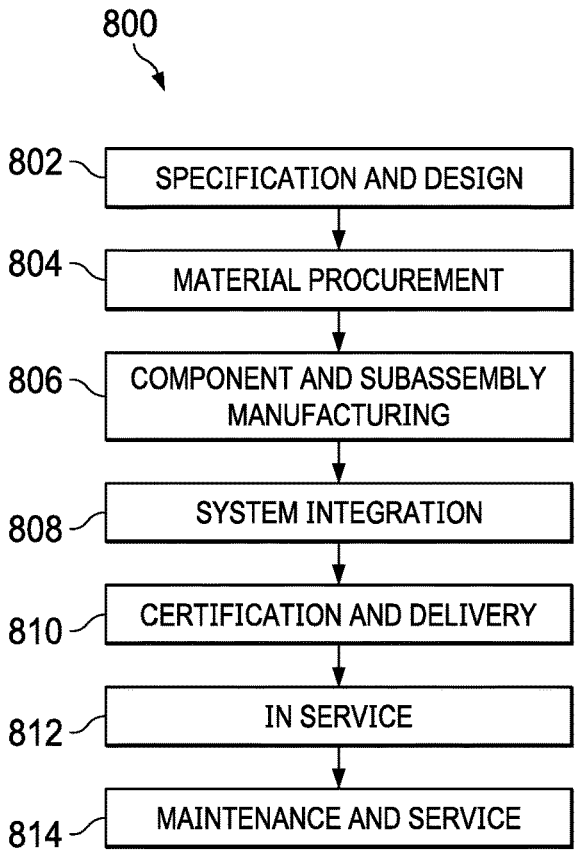
FIG. 8 is an illustration of a block diagram of an aircraft manufacturing and service method, in accordance with an illustrative embodiment.
Figure 9:
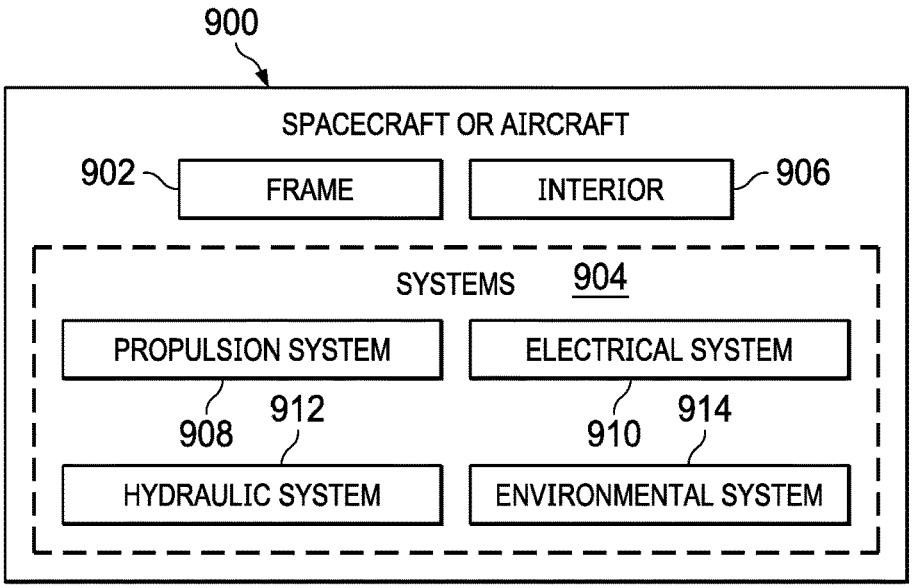
FIG. 9 is an illustration of a block diagram of an aircraft in which an illustrative embodiment may be implemented.

Illustrative embodiments of the disclosure may be described in the context of aircraft manufacturing and service method 800 as shown in FIG. 8 and aircraft 900 as shown in FIG. 9. However, the illustrative embodiments described herein are applicable to any machine or vehicle that uses an exhaust system or exhaust pipe, including but not limited to automobiles and generators. The techniques described herein may be used to manufacture aircraft 900 using aircraft manufacturing and service method 800. The techniques described with respect to FIG. 8 and FIG. 9 may take advantage of the inspections systems, devices, and methods described with respect to FIG. 1 through FIG. 7.

Turning first to FIG. 8, an illustration of an aircraft manufacturing and service method is depicted in accordance with an illustrative embodiment. During pre-production, aircraft manufacturing and service method 800 may include specification and design 802 of aircraft 900 in FIG. 9 and material procurement 804.

During production, component and subassembly manufacturing 806 and system integration 808 of aircraft 900 in FIG. 9 takes place. Thereafter, aircraft 900 in FIG. 9 may go through certification and delivery 810 in order to be placed in service 812. While in service 812 by a customer, aircraft 900 in FIG. 9 is scheduled for routine maintenance and service 814, which may include modification, reconfiguration, refurbishment, and other maintenance or service.

The exhaust system self-cleaning techniques described with respect to FIG. 1 through FIG. 7 may be applied with respect to method 800 and aircraft 900. For example, the illustrative embodiments described above may be applied, for example, on at least operations 806, 808, and 814, to build airframe 902 and interior 906, or used with such systems.

Each of the processes of aircraft manufacturing and service method 800 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 9, an illustration of an aircraft 900 is depicted in which an illustrative embodiment may be implemented. In this example, aircraft 900 is produced by aircraft manufacturing and service method 800 in FIG. 8 and may include airframe 902 with plurality of systems 904 and interior 906. Examples of systems 904 include one or more of propulsion system 908, electrical system 910, hydraulic system 912, and environmental system 914. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 800 in FIG. 8.

In one illustrative example, components or subassemblies produced in component and subassembly manufacturing 806 in FIG. 8 may be fabricated or manufactured in a manner similar to components or subassemblies produced while aircraft 900 is in service 812 in FIG. 8. As yet another example, one or more apparatus embodiments, method embodiments, or a combination thereof may be utilized during production stages, such as component and subassembly manufacturing 806 and system integration 808 in FIG. 8. One or more apparatus embodiments, method embodiments, or a combination thereof may be utilized while aircraft 900 is in service 812 and/or during maintenance and service 814 in FIG. 8. The use of a number of the different illustrative embodiments may substantially expedite the assembly of and/or reduce the cost of aircraft 900.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A self-cleaning duct assembly comprising:

a hollow member having an inner surface, the inner surface defining a central axis and a flow passage for directing a fluid flow along the central axis;

a resilient member including a plurality of arcuate segments disposed along the central axis, each of the arcuate segments spaced from the inner surface; and a slot disposed in the inner surface of the hollow member, wherein a prong of the resilient member is disposed in and slidable along the slot;

wherein the arcuate segments intermittently contact the inner surface as the resilient member is induced to move within the hollow member.

2. The self-cleaning duct assembly of claim 1, wherein the fluid flow through the hollow member induces the resilient member to move.

3. The self-cleaning duct assembly of claim 1, wherein the hollow member is coupled to an engine and operational vibrations from the engine induce the resilient member to move.

4. The self-cleaning duct assembly of claim 1, wherein the resilient member and the central axis are concentric.

5. The self-cleaning duct assembly of claim 1, wherein the resilient member is connected to the hollow member solely at one end of the hollow member.

6. The self-cleaning duct assembly of claim 1, wherein the resilient member comprises a helical coil.

7. A self-cleaning exhaust system comprising:

an exhaust duct connectable to a machine that produces exhaust, the exhaust duct having a longitudinal axis, a first diameter, and an inner wall;

a coil connected to the exhaust duct and disposed inside the exhaust duct along the longitudinal axis, the coil having a pitch and a second diameter, wherein the second diameter is less than the first diameter; and a slot disposed in the inner wall of the duct, wherein a prong of the coil is disposed in and slidable along the slot;

wherein the coil is configured to vibrate with an amplitude sufficiently large such that at least part of the coil will repeatedly impact the inner wall when exhaust flows through the exhaust duct.

8. The self-cleaning exhaust system of claim 7, wherein the coil and the longitudinal axis are concentric.

9. The self-cleaning exhaust system of claim 7, wherein the coil is connected to the exhaust duct solely at one end of the exhaust duct.

10. The self-cleaning exhaust system of claim 7, wherein the prong is disposed in an exit end of the exhaust duct.

11. The self-cleaning exhaust system of claim 7, wherein the coil comprises a helical coil.

12. The self-cleaning exhaust system of claim 7, wherein the coil comprises a pitch, and wherein the pitch is selected such that an entire surface of the inner walls is contacted by the coil during vibration and extension of the coil while the exhaust duct is in operational use.

13. The self-cleaning exhaust system of claim 7, wherein the second diameter is between about 60% and 98% of the first diameter of the exhaust duct.

14. The self-cleaning exhaust system of claim 7, wherein the coil comprises stainless steel.

15. The self-cleaning exhaust system of claim 7, wherein the coil has a gauge selected such that a total area of the coil is between about 2% and 20% of an area of the exhaust duct.

16. The self-cleaning exhaust system of claim 7, wherein the exhaust duct comprises a muffler.

17. The self-cleaning exhaust system of claim 16, wherein the exhaust system is connected to the machine.

18. A method self-cleaning an exhaust system, the method comprising:

receiving, in an exhaust duct, a flow of exhaust gas;

inducing vibrations, using the flow of exhaust gas, in a coil disposed inside the exhaust duct, wherein the coil includes a plurality of arcuate segments disposed along a central axis of the exhaust duct and spaced from inner walls of the exhaust duct;

impacting, via the vibrations, the inner walls of the exhaust duct by the coil with sufficient force such that exhaust residue from the exhaust gas either is removed from the inner walls or prevented from being deposited on the inner walls; and allowing a prong of the coil to slide within a slot disposed in the inner walls.

19. The method of claim 18, wherein the exhaust gas is produced by a machine connected to the exhaust duct, and wherein the method further comprises:

operating the machine.

20. The method of claim 18, wherein inducing vibrations includes vibrations in both an axial direction of the coil and a radial direction of the coil.

* * * * *